United States Patent [19]

Gibbs

[11] Patent Number: 4,934,388

[45] Date of Patent: Jun. 19, 1990

[54] COLLOIDAL SOLUTION APPLICATOR WITH HAIR-PARTING WAND

[76] Inventor: Michael Gibbs, 3317 Mansfield, Houston, Tex. 77091

[21] Appl. No.: 279,985

[22] Filed: Dec. 5, 1988

[51] Int. Cl.[5] ..... A45D 24/22; A45D 24/26

[52] U.S. Cl. ..... 132/116; 132/112; 401/176; 401/182

[58] Field of Search ..... 401/176, 182; 132/112, 132/113, 114, 115, 116

[56] References Cited

U.S. PATENT DOCUMENTS

| | | | |
|---|---|---|---|
| 203,256 | 5/1878 | Frobisher | 401/176 |
| 1,629,389 | 5/1927 | Johnson | 132/114 |
| 2,249,401 | 7/1941 | Sieg | 401/176 |
| 2,723,411 | 11/1955 | Ellis | 401/176 X |
| 3,960,160 | 6/1976 | Hogan | 132/112 |

FOREIGN PATENT DOCUMENTS

| | | | |
|---|---|---|---|
| 553845 | 1/1957 | Belgium | 401/176 |
| 1258361 | 3/1961 | France | 401/279 |
| 2400865 | 4/1979 | France | 401/176 |

*Primary Examiner*—Steven A. Bratlie
*Attorney, Agent, or Firm*—Neal J. Mosely

[57] ABSTRACT

A hand-held colloidal solution applicator particularly suited for applying relatively viscous solutions such as gels and pastes to the hair comprises a generally cylindrical rigid container for receiving the hair treating solution and has opposed externally threaded ends. A comb-like applicator nozzle is threadedly received on one end of the container for properly placing and distributing the solution and a non-dispensing hair-parting wand having a cap portion is threadedly received on the other end of the container opposite the applicator end and has a central opening through the cap portion end wall. The hair-parting wand extends outwardly from the cap portion end wall parallel to the longitudinal axis of the container and is laterally offset from the central opening. A dispensing plunger has a shaft portion extending slidably through the central opening with a piston at one end disposed within the container and the outwardly extending end of the shaft portion receives the thumb of the operator for sliding the piston within the container to force the solution through the applicator nozzle. The thumb operated piston feature reduces hand fatigue of the operator while giving more precise control over the work, and having the hair-parting wand and dispensing nozzle at opposite ends of the applicator eliminates the problems of accidental dripping of the contents onto the scalp or hair and the wand constantly interferring with the nozzle and vice-versa.

5 Claims, 1 Drawing Sheet

COLLOIDAL SOLUTION APPLICATOR WITH HAIR-PARTING WAND

BACKGROUND OF THE INVENTION

1. Field of the Invention

This invention relates generally to hair-dressing apparatus, and more particularly to a hand-held plunger type applicator for applying viscous compositions to the hair and has a hair-parting wand on the end opposite the applicator nozzle.

2. Brief Description of the Prior Art

Many hair treatment compositions, particularly hair relaxers, produce adverse side effects if not properly applied. Care must be taken so as not to allow direct contact of the solution to the scalp. Hair relaxer solutions contain sodium hydroxide and other chemicals which will cause chemical burns to the scalp and discomfort to the patron. Skill is required in applying the proper quantity of solution to the new growth of hair located close to the scalp without actualy contacting the scalp, and spreading it evenly to the remaining parts of the hair. The hair can be damaged by "over processing" if too much solution is applied or the solution is not smoothly overlapped into the previously treated portions of the hair.

Prior art methods of applying hair gels and pastes such as hair relaxers include the practice of wearing a rubber glove and scooping the solution from a jar by hand, then applying it and smoothing it with the fingers. Another method is dipping a rattail comb or brush into the jar and using the tail of the comb or bristles of the brush to apply and smooth the solution.

Applicators for applying hair treatment solutions to the hair or scalp are known in the art and there are several patents which disclose applicators of various construction which do not allow the precise control and utilitity provided by the combination of features of the present invention.

The "squeeze bottle" and bulb type applicators are unsatisfactory because they require repeated manual compression of the container or bulb resulting in fatigue of the hands of the hairdresser, especially if dispensing a viscous solution. Devices which have a parting-wand on the same end of the applicator nozzle are unsatisfactory because the wand will be constantly interferring with the nozzle and vice-versa. They are also prone to accidental dripping the hair treatment solution onto the scalp from the nozzle when working the hair with the wand.

Roppatte, Jr., U.S. Pat. Nos. 4,354,572 and 4,354,512 are hair applicator devices which utilize a squeeze bottle. There is no plunger and a hair-parting wand is provided on the same end as the applicator nozzle and extends angularly relative thereto. This device recognizes the problem of the applicator nozzle and the wand interferring with one another in use and attempts to solve it by angularly separating the tip of the wand from the nozzle by a distance of from 2 to 5 inches.

Stanford, U.S. Pat. No. 2,956,570 and Battle, U.S. Pat. No. 2,299,295 disclose hair applicator devices which also utilizes a squeeze bottle. There is no plunger and the hair-parting wand is on the same end as the applicator and is placed in front of the applicator.

Sayer, U.S. Pat. No. 2,895,486 also uses a squeeze bottle. There is no plunger and the hair parting wand is on the same end as the applicator and is placed parallel to the applicator.

Wela, German Patent 3,013,769 discloses still another hair applicator utilizing a squeeze bottle. There is no plunger and the hair-parting wand is on the same end as the applicator. The applicator surrounds the hair-parting wand and has a comb on one side and bristles on another side.

Lawrence, U.S. Pat. No. 2,895,486 uses a squeeze bulb to apply a solution. There is no plunger and the hair parting wand is on the same end as the applicator and is placed parallel to the applicator.

Herfert, U.S. Pat. No. 712,530, Canadian Patent 494,751, and French Patent 7,361 disclose curry combs and hair combs which do not have a hair-parting wand and utilize a plunger to suck water into the instrument.

Cochran, U.S. Pat. No. 4,294,270 discloses a comb having a manifold backbone which is screwed on to a squeeze bottle reservoir and is angularly disposed relative thereto. There is no plunger and no hair parting wand.

Shipp, U.S. Pat. No. 4,310,009 discloses a screw-on comb applicator structure having hollow teeth and a baffle for equalizing the flow of fluid to each of the hollow teeth.

The present invention is distinguished over the prior art in general, and these patents in particular by a hand-held colloidal solution applicator particularly suited for applying relatively viscous solutions such as gels and pastes to the hair which comprises a generally cylindrical rigid container for receiving the hair treating solution and has opposed externally threaded ends. A comb-like applicator nozzle is threadedly received on one end of the container for properly placing and distributing the solution and a non-dispensing hair-parting wand having a cap portion is threadedly received on the other end of the container opposite the applicator end and has a central opening through the cap portion end wall. The hair-parting wand extends outwardly from the cap portion end wall parallel to the longitudinal axis of the container and is laterally offset from the central opening. A dispensing plunger has a shaft portion extending slidably through the central opening with a piston at one end disposed within the container and the outwardly extending end of the shaft portion receives the thumb of the operator for sliding the piston within the container to force the solution through the applicator nozzle. The thumb operated piston feature reduces hand fatigue of the operator while giving precise control over the work, and having the hair-parting wand and dispensing nozzle at opposite ends of the applicator eliminates the problems of accidental dripping of the contents onto the scalp or hair and the wand constantly interferring with the nozzle and vice-versa.

SUMMARY OF THE INVENTION

It is therefore an object of the present invention to provide a hand-held colloidal solution applicator for properly placing and applying relatively viscous compositions to the hair.

It is another object of this invention to provide a hand-held colloidal solution applicator for applying compositions to the hair that utilizes a thumb operated piston to dispense the contents which will not unduly fatigue the hands of the hairdresser.

Another object of this invention is to provide a hand-held colloidal solution applicator for applying compositions to the hair which has a parting-wand and a dispensing nozzle at opposite ends of the applicator which will eliminate the problem of the wand constantly interferring with the nozzle and viceversa.

Another object of this invention is to provide a hand-held colloidal solution applicator for applying compositions to the hair which has a parting-wand and a dispensing nozzle at opposite ends of the applicator which will eliminate the problem of accidental dripping of the contents when working the hair with the wand.

Another object of this invention is to provide a hand-held colloidal solution applicator for applying compositions to the hair which has a parting-wand and a dispensing nozzle at opposite ends of the applicator in combination with a thumb operated plunger to allow the hairdresser to have better and more efficient control over his work and proper dispensing of the contents with little hand fatigue.

A further object of this invention is to provide a handheld colloidal solution applicator for applying compositions to the hair which is easily and quickly assembled and disassembled for filling or cleaning.

A still further object of this invention is to provide a colloidal solution applicator for applying compositions to the hair which is simple in construction, economical to manufacture, and rugged and reliable in operation.

Other objects of the invention will become apparent from time to time throughout the specification and claims as hereinafter related.

The above noted objects and other objects of the invention are accomplished by a hand-held colloidal solution applicator particularly suited for applying relatively viscous solutions such as gels and pastes to the hair which comprises a generally cylindrical rigid container for receiving the hair treating solution and has opposed externally threaded ends. A comb-like applicator nozzle is threadedly received on one end of the container for properly placing and distributing the solution and a non-dispensing hair-parting wand having a cap portion is threadedly received on the other end of the container opposite the applicator end and has a central opening through the cap portion end wall. The hair-parting wand extends outwardly from the cap portion end wall parallel to the longitudinal axis of the container and is laterally offset from the central opening. A dispensing plunger has a shaft portion extending slidably through the central opening with a piston at one end disposed within the container and the outwardly extending end of the shaft portion receives the thumb of the operator for sliding the piston within the container to force the solution through the applicator nozzle. The thumb operated piston feature reduces hand fatigue of the operator while giving more precise control over the work, and having the hair-parting wand and dispensing nozzle at opposite ends of the applicator eliminates the problems of accidental dripping of the contents onto the scalp or hair and the wand constantly interferring with the nozzle and vice-versa.

DESCRIPTION OF THE PREFERRED EMBODIMENT

Figure 1:
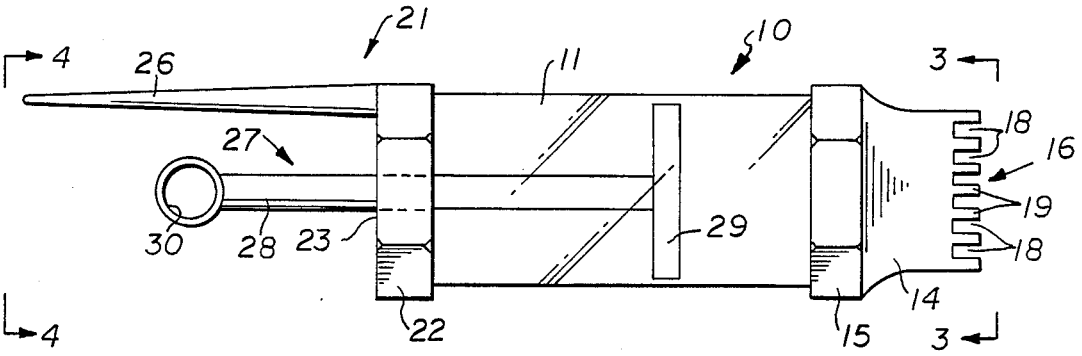
FIG. 1 is a side elevation of the colloidal solution applicator with a hair-parting wand in accordance with the present invention.

Referring to the drawings by numerals of reference, there is shown a preferred colloidal solution applicator 10. The applicator 10 is particularly suited to utilize hair treatment chemicals and solutions, and particularly gels and pastes, such as hair relaxer or straightener compounds which are relatively viscous and do not flow readily under gravitational influence. The applicator 10 comprises a hollow cylindrical reservoir or container 11 having external threads 12 and 13 at opposite ends and is of sufficient size to be gripped in the palm of the hand of the operator. The container 11 is formed of rigid material and may be transparent so that the contents are visible.

An applicator nozzle 14 has an integral cap portion 15 at one end and a comb-like outlet portion 16 at the other end. The cap portion 15 has internal threads 17 which engage the threads 12 at one end of the container for removable installation thereon. The exterior of the nozzle 14 makes a smooth transition from a generally cylindrical cap portion 15 to the flat rectangular comb-like outlet portion 16. The front edge of the comb-like outlet portion 16 is provided with a plurality of rearwardly extending slots or recesses 18 defining a plurality of teeth 19 therebetween.

The interior of the nozzle 14 has a generally flat slot or central passageway 20 which extends from the interior threaded portion 17 and expands angularly outward at the flat rectangular comb-like outlet portion 16. When viewed from the front end, passageway 20 extends substantially the width of the rectangular toothed portion 16 to divide the teeth 19 into two parallel spaced rows. The size of the passageway 20 and space between the toothed rows is sufficient to conduct viscous gel and paste material, such as hair relaxer or straightener compounds from the container interior and distribute it evenly at the toothed end of the nozzle. The length of the recesses 18 are such that the dispensed solution will first contact the hair approximately ¼" to ½" from the scalp.

A hair-parting wand member 21 comprises a generally cylindrical base or cap portion 22 having an end wall 23 and internal threads 24 which engage the threads 13 at the other end of the container 11 for removable installation thereon. A central bore 25 extends through the end wall 23. A hair-parting wand 26 laterally offset from the central bore 25 extends from the cap portion end wall 23 parallel to the longitudinal axis of the container 11. The wand 26 is tapered to resemble the "rattail" portion of a "rattail comb" and is used to separate or part the hair during use of the device in the hair treatment operations as described below.

A dispensing plunger 27 has a central shaft portion 28 which extends slidably through the central bore 25 of the end wall 23 of the cap portion 22 and a piston 29 at one end slidably disposed within the interior of the container 11 and the outwardly extending end of the shaft has a circular ring portion 30 to receive the thumb of the operator for sliding the piston axially within the container. The exterior of the piston 29 forms a reciprocating fluid sealing relation with the interior wall of the container 11 such that when pushed inwardly toward the nozzle end it will force the gel or paste material through the passageway 20 in the applicator nozzle 14.

Figure 4:
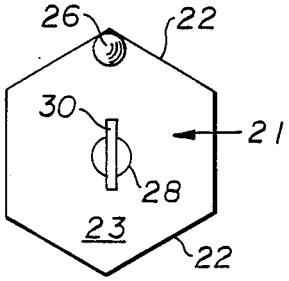
FIG. 4 is an end view of the hair-parting wand end of the colloidal solution applicator.
Figure 3:
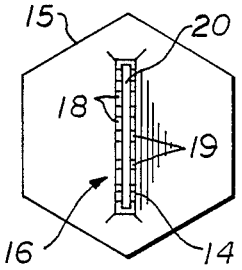
FIG. 3 is an end view of the nozzle end of the colloidal solution applicator.
Figure 2:
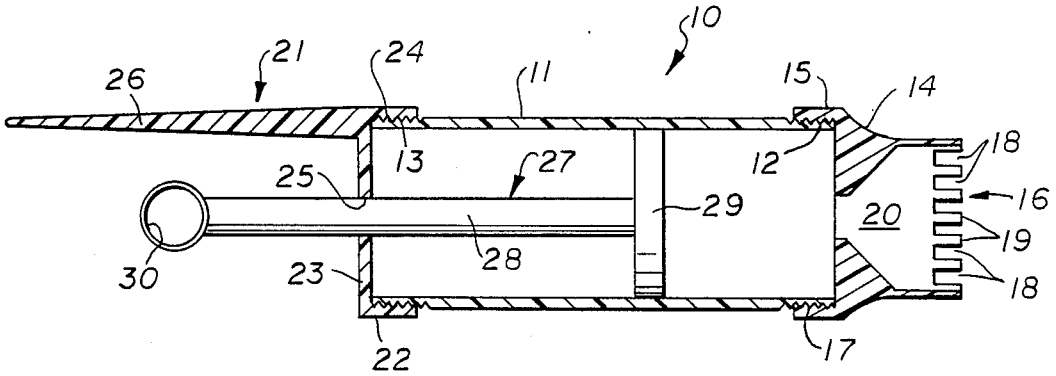
FIG. 2 is a cross section of the colloidal solution applicator of FIG. 2.
Figure 5:
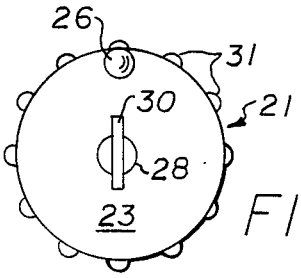
FIG. 5 is an end view of a modified hair-parting wand member having a knurled exterior surface.

The exterior of the cap portion 22 of the wand 21 and the cap portion 15 of the nozzle 14 may be formed in a polygonal configuration (FIGS. 3 and 4) or knurled 31 (FIG. 5) to provide a finger gripping surface allowing the wand and nozzle to be easily and quickly installed on or removed from the threaded ends of the container by hand, even if the hands are wet.

All the components of the applicator are preferably constructed of a suitable high impact thermoplastic material which will resist hair treatment chemicals, such as sodium hydroxide, and are heat resistant so that they may be used repeatedly over long periods of time and may be easily washed and cleaned by conventional methods.

OPERATION

The following description will use the hair relaxer treatment as an example of the method of using the apparatus, however, it should be understood that the device may be used in a similar manner in various other hair treatment operations. As a precautionary measure, in applying hair relaxer and other solutions having string chemicals, a base cream may be applied around the hairline and nape of the neck of persons having a sensitive scalp. A glove may be worn on the free hand of the hairdresser.

To use the applicator of the present invention, the operator unscrews the nozzle from the end of the container and draws the plunger to the rearmost position. The container is then filled with the desired hair treatment compound or solution with a spatula or other means. While various hair treatment solutions may be used in the container, the present applicator is particularly suited to utilize gels and pastes, such as hair relaxer or straightener compounds which are relatively viscous and do not flow readily under gravitational influence. It should be understood that such gels and pastes may be supplied in tubes that can be inserted into the container and dispensed with the plunger.

After the container has been filled, the applicator nozzle is screwed onto the end of the container and the hairdresser is ready to begin the hair relaxing treatment.

Gripping the applicator in the palm of the hand and using the parting wand, the hairdresser parts the hair into sections. The hair at the nape of the neck is subdivided into thin sections, approximately ¼" wide depending upon hair density. By turning the wrist, the applicator is turned to place the nozzle adjacent the part of one section of hair and the parting wand facing away from the scalp. In this position, the ends of the teeth of the nozzle are at the part and the recesses terminate approximately ¼" to ½" above the scalp. Placing the applicator at an angle, the recesses contact the hair.

Pressing with the thumb, the hairdresser draws the nozzle through the section of hair while carefully dispensing the solution. The dispensed solution will first contact the hair approximately ¼" to ½" from the scalp. Because it is relatively viscous, the dispensed solution will remain on the surface of the hair and by drawing the nozzle through the hair, the flat surface of the nozzle and its teeth will smooth and work the solution evenly through the thickness of the hair.

On hair which has not been previously treated, the solution is smoothed throughout the length of the hair from approximately ½" from the scalp to approximately ½" from the end of the hair in the sections. During the smoothing operation, additional amounts of the solution may be applied as required by the hairdresser pressing his or her thumb. This gives the hairdresser very precise control over the placement and quantity of solution dispensed, and at the same time, allows an even smoothing of the solution into the hair. By again flipping the wrist, the hairdresser may also smooth the solution into the hair and away from the scalp by placing the long side of the parting wand against the hair and running it toward the end of the hair section.

The process of applying relaxer to hair which has been previously treated is known in the trade as a "retouch". In this process, the relaxer solution is applied only to the new growth of hair located close to the scalp. The hair is parted and sectioned as described previously. The applicator is turned to place the nozzle adjacent the part of one section of hair and the parting wand facing away from the scalp. In this position, the ends of the teeth of the nozzle are at the part and the recesses terminate approximately ¼" to ½" above the scalp. Placing the applicator at an angle, the recesses contact the hair.

Pressing with the thumb, the hairdresser draws the nozzle outwardly from the part while carefully dispensing the solution only on the new growth of hair. The hairdresser then draws the nozzle through the hair while smoothing and working the solution into the hair as described above, and just bearly overlapping the solution at the point at which the previously treated hair begins. Skill is required in applying the proper quantity of solution to the new growth of hair located close to the scalp without actualy contacting the scalp, and spreading it evenly. The hair can be damaged by "over processing" if too much solution is applied or the solution is not smoothly overlapped into the previously treated portions of the hair. After processing, the hair is shampooed until all the solution is removed.

The feature of being able to stratigically apply and quickly smooth the solution is very important, since many solutions contain chemicals which produce adverse side effects if direct contact to the scalp or prolonged time in contact with the hair is allowed. Discomfort and chemical burns to the scalp and damage to the hair may occur as a result of applying the solution too close to the scalp, applying too much solution, and/or improperly smoothing the solution through the hair.

While this invention has been described fully and completely with special emphasis upon a preferred embodiment, it should be understood that within the scope of the appended claims the invention may be practiced otherwise than as specifically described herein.

I claim:

1. A hand-held colloidal solution applicator for applying relatively viscous caustic solutions such as gels and pastes to the hair comprising;

a rigid container for receiving said viscous caustic solution comprising a hollow generally cylindrical member of sufficient size to be held in the palm of the operator and having externally threaded opposed ends, an applicator nozzle positioned at one end of said hollow cylindrical member for receiving and distributing said solution, said applicator nozzle having an integral cap portion at one end internally threaded and removably attached on one end of said hollow cylindrical member and a generally flat comb-like outlet portion extending outwardly from the cap portion and defining an outwardly expanded flat passageway, the outward end of said comb-like outlet portion having an edge with a plurality of outwardly extending recesses defining a plurality of teeth therebetween, said outwardly expanded flat passageway extending substantially the width of the rectangular toothed portion to divide the teeth into two parallel spaced rows, the size of said passageway being sufficient to conduct viscous gel and paste materials from the container interior and distribute it evenly at the toothed end of said nozzle, said flat passageway extending from the interior threaded portion of said cap portion and angularly outward at the flat rectangular comb-like outlet portion, a non-dispensing hair-parting wand having a generally cylindrical cap portion internally threaded and removably attached on the other end of said hollow cylindrical member opposite said applicator nozzle and having an end wall with a central opening therethrough, said hair-parting wand extending outwardly from said cap portion end wall parallel to the longitudinal axis of said container and laterally offset from said central opening, a dispensing plunger having a shaft portion extending slidably through said cap portion central opening with a piston at the inwardly extended end disposed within said container to form a reciprocating fluid sealing relation with the interior wall thereof and the outwardly extending end of the shaft portion configured to receive the thumb of the operator for sliding said piston within said container to force said solution through said applicator nozzle, said applicator nozzle and said hair-parting wand exterior surfaces being configured to provide a finger gripping surface to facilitate installation on and removal from said container, and said rigid hollow cylindrical member, said applicator nozzle, said hair-parting, and said dispensing plunger being formed of a washable heat-resistant thermoplastic material resistant to caustic-containing heat treatment chemicals.

2. A hand-held colloidal solution applicator according to claim 1 wherein the exterior finger gripping portions of said hair-parting wand and said nozzle are of polygonal configuration.

3. A hand-held colloidal solution applicator according to claim 1 wherein the exterior finger gripping portions of said hair-parting wand and said nozzle are knurled.

4. A hand-held colloidal solution applicator according to claim 1 wherein said rigid container is formed of transparent material to provide visibility of the contents.

5. A hand-held colloidal solution applicator according to claim 1 wherein the outwardly extending portion of said hair-parting wand is tapered and of sufficient diameter to facilitate separating and parting the hair.

* * * * *